US008047265B2

(12) United States Patent
Harada et al.

(10) Patent No.: US 8,047,265 B2
(45) Date of Patent: Nov. 1, 2011

(54) ELECTROMAGNETIC STIRRER COIL

(75) Inventors: Hiroshi Harada, Himeji (JP); Akinori Wakagi, Himeji (JP); Tomohiro Konno, Himeji (JP); Keisuke Fujisaki, Futtsu (JP); Ryu Hirayama, Futtsu (JP); Sumio Matsumori, Himeji (JP); Yasuji Tomizawa, Himeji (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 13/068,284

(22) Filed: May 5, 2011

(65) Prior Publication Data

US 2011/0214837 A1 Sep. 8, 2011

Related U.S. Application Data

(63) Continuation of application No. 11/664,747, filed as application No. PCT/JP2005/019249 on Oct. 13, 2005.

(30) Foreign Application Priority Data

Oct. 15, 2004 (JP) ..... 2004-300852

(51) Int. Cl.
*B22D 27/02* (2006.01)

(52) U.S. Cl. ..... 164/504; 164/502; 164/466; 164/468

(58) Field of Classification Search ..... 164/466, 164/468, 502, 504

See application file for complete search history.

(56) References Cited

U.S. PATENT DOCUMENTS

| | | | |
|---|---|---|---|
| 5,238,051 | A | 8/1993 | Kikuchi et al. |
| 5,746,265 | A | 5/1998 | Hoyt et al. |
| 5,746,268 | A | 5/1998 | Fujisaki et al. |

FOREIGN PATENT DOCUMENTS

| | | | |
|---|---|---|---|
| EP | 0 577 831 | | 1/1994 |
| JP | 56041054 | A | 4/1981 |
| JP | 57-091855 | | 6/1982 |
| JP | 11-123511 | | 5/1999 |
| JP | 2000-176608 | A | 6/2000 |
| JP | 2000-246396 | A | 9/2000 |
| JP | 2000-271710 | | 10/2000 |
| JP | 2001-047195 | | 2/2001 |
| JP | 3273105 | | 4/2002 |
| JP | 2005238276 | A | 9/2005 |

OTHER PUBLICATIONS

Supplementary European Search Report dated Sep. 1, 2008 issued in corresponding European Application No. 05 79 5770.

European Office Action in application EP 05 795 770.6 dated Feb. 22, 2010.

*Primary Examiner* — Jessica L Ward
*Assistant Examiner* — Nicholas D'Aniello
(74) *Attorney, Agent, or Firm* — Kenyon & Kenyon, LLP

(57) ABSTRACT

The present invention provides a previously unattainable compact and high thrust electromagnetic stirrer coil, that is, an electromagnetic stirrer coil for stirring molten steel in a mold by electromagnetic force, in which electromagnetic stirrer coil a space factor of the yoke sectional area (–) with respect to an inside area in a vertical cross-section of said electromagnetic stirrer coil is 0.5 to 0.9 and a yoke width B is 100 mm to 300 mm. Preferably, a magnetomotive force F of said electromagnetic stirrer coil divided by the yoke width B, that is, a value of F/B, is 800 kAT/m or more.

3 Claims, 4 Drawing Sheets

(a)

(b)

ELECTROMAGNETIC STIRRER COIL

This application is a continuation application under 35 U.S.C. §120 of prior U.S. application Ser. No. 11/664,747, filed Apr. 4, 2007 which is a 35 U.S.C. §371 of PCT/JP05/19249 filed Oct. 13, 2005, which claims priority to Japanese Application No. 2004-300852, filed Oct. 15, 2004, each of which is incorporated by reference in its entirety.

TECHNICAL FIELD

The present invention relates to an electromagnetic stirrer coil for stirring molten steel in a mold by electromagnetic force.

BACKGROUND ART

In the past, in a continuous casting facility, to cause non-metallic inclusions included in the molten steel in a mold and bubbles of Ar gas blown into an immersion nozzle to rise to the surface of the molten steel without being trapped in the slab and thereby obtain a good quality slab, the method has been used of stirring the molten steel in the mold by electromagnetic force. Various proposals have been made in the past relating to electromagnetic stirrer coils for stirring molten steel in a mold by electromagnetic force.

For example, Japanese Patent No. 3273105 discloses a fluid motion control system providing a second core abutting against a back surface of a first core (yoke) having slots for winding of a coil and a third core abutting against the top and bottom surfaces of the first core (yoke) so as to increase the effective area of the core and increase the saturation flux density and thereby enable a stronger magnetic field to be applied to the molten metal while retaining about the same outside shape as in conventional systems.

However, Japanese Patent No. 3273105 discloses a method of increasing the effective area of the core (yoke), but the specific ranges of numerical values of the space factor of the yoke sectional area (–) with respect to the inside area in the horizontal cross-section of the electromagnetic stirrer coil corresponding to that effective area and the yoke width B were not sufficiently studied, so a compact and high thrust electromagnetic stirrer coil could not be realized.

DISCLOSURE OF THE INVENTION

The present invention has as its object to solve the above problems in the prior art and provide a never previously attainable compact and high thrust electromagnetic stirrer coil.

The inventors engaged in in-depth studies to achieve the above object and as a result provided a compact and high thrust electromagnetic stirrer coil by specifying preferable ranges of numerical values for the space factor of the yoke sectional area (–) with respect to an inside area in a vertical cross-section of the electromagnetic stirrer coil corresponding to the effective area of the core (yoke) and for the yoke width B. It has as its gist the following content:

(1) An electromagnetic stirrer coil for stirring molten steel in a mold by electromagnetic force, said electromagnetic stirrer coil characterized in that a space factor of the yoke sectional area (–) with respect to an inside area in a vertical cross-section of said electromagnetic stirrer coil is 0.5 or more and a yoke width B is 100 mm to 300 mm.

(2) An electromagnetic stirrer coil as set forth in (1) characterized in that a magnetomotive force F of said electromagnetic stirrer coil divided by the yoke width B, that is, a value of F/B, is 800 kAT/M or more.

BEST MODE FOR CARRYING OUT THE INVENTION

The best mode for carrying out the present invention will be explained in detail using FIG. 1 to FIG. 7.

Figure 1:
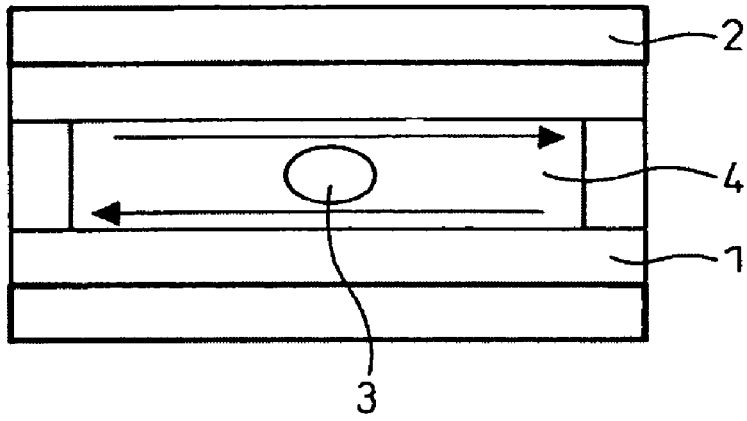
FIG. 1 are views illustrating an embodiment of an electromagnetic stirrer coil in the present invention, wherein (a) is a plan view and (b) is a side view.
Figure 1:
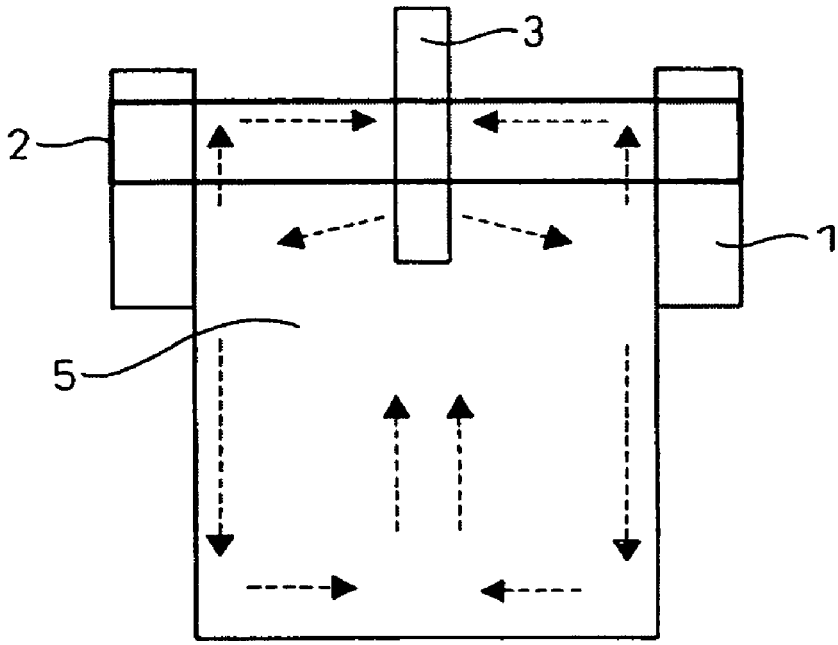
Figure 2:
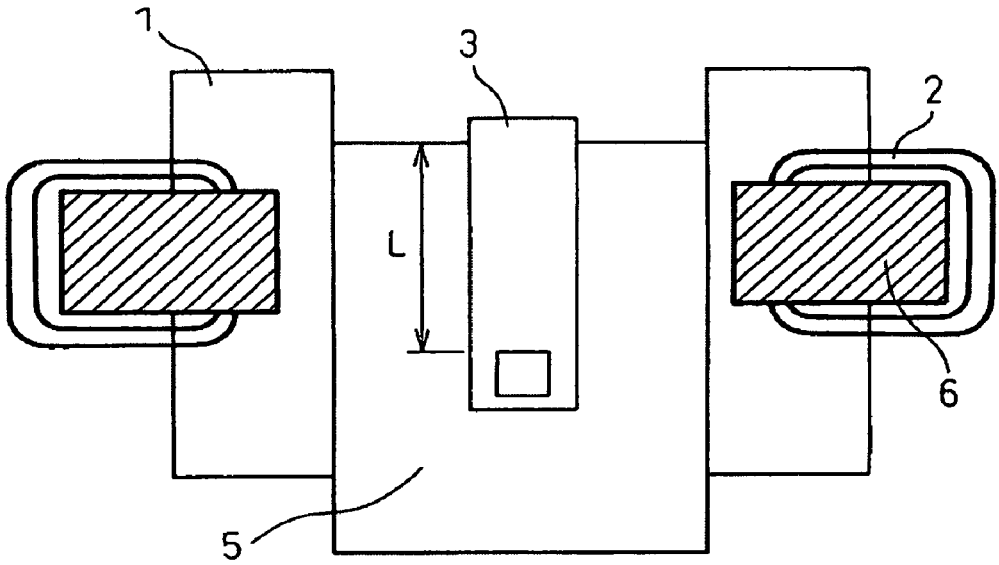
FIG. 2 is a detailed view (sectional view) of the top of a mold including the electromagnetic stirrer coil in the present invention as seen from the side surface.
Figure 3:
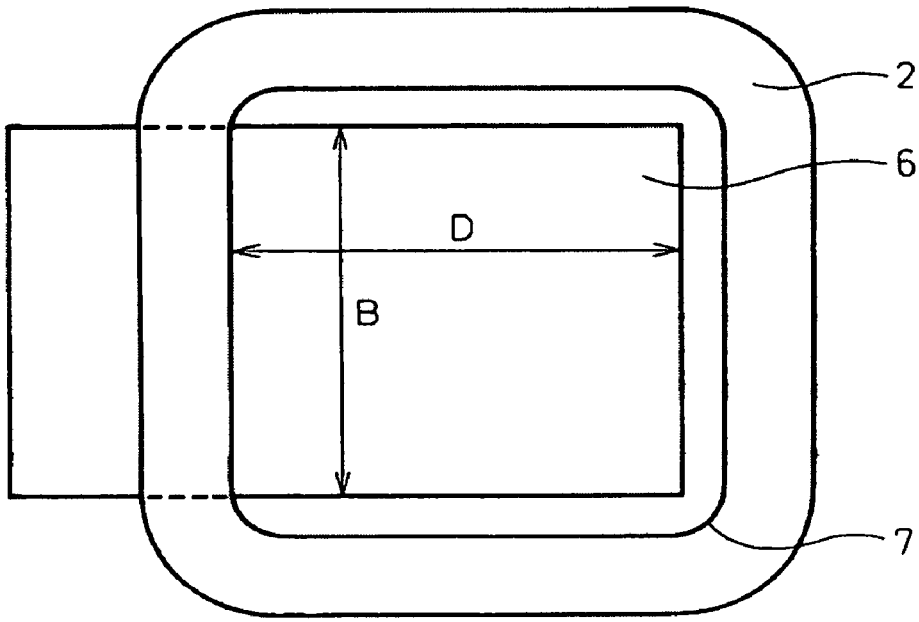
FIG. 3 is a detailed view of an electromagnetic stirrer coil part in the present invention.

FIG. 1, FIG. 2, and FIG. 3 are views illustrating an embodiment of an electromagnetic stirrer coil in the present invention.

In FIG. 1 and FIG. 2, 1 indicates a mold, 2 an electromagnetic stirrer coil, 3 an immersion nozzle, 4 molten steel, 5 a strand pool, and 6 a yoke.

FIG. 1(*a*) is a plan view of the electromagnetic stirrer coil of the present invention, while (b) is its side view.

The mold 1 of a continuous casting machine is filled with molten steel 4. By running a current through the electromagnetic stirrer coil 2 arranged around that mold 1, an electromagnetic force is generated, thrust in the arrow (solid line) direction acts on the molten steel 1, and the molten steel 4 in the strand pool 5 is stirred.

Further, at the center of the strand pool 5, the immersion nozzle 3 is set. This immersion nozzle 3 injects molten steel into the mold. As a result, a flow of molten steel 4 (broken line) is formed. Formation of these two flows without allowing any interference between them is necessary for casting a good quality slab.

FIG. 2 is a detailed view of the mold part including the electromagnetic stirrer coil in the present invention as seen from the side surface (vertical cross-section), while FIG. 3 is an enlarged view (sectional view) of the coil part.

Inside the electromagnetic stirrer coil 2 is placed the yoke 6 corresponding to a core. Power is supplied to the coil wound around this yoke to generate a magnetic field. The present invention is characterized in that the space factor (–) of the sectional area (B×D) of the yoke 6 with respect to the inside area in the vertical cross-section of the electromagnetic stirrer coil 2 (specifically the inside area surrounded by the outside shape 7 of the coil window of FIG. 3) is 0.5 or more and the yoke width B is 100 mm to 300 mm.

First, the reasons for limitation of the yoke width B will be explained.

The yoke width B in the vertical cross-section of the electromagnetic stirrer coil 2 shown in FIG. 2 is made 100 mm or more because 100 mm or more is necessary in order to try to improve the cleanliness of the slab surface part by imparting fluid motion to the front surface of the solidified shell.

Further, the yoke width B in the vertical cross-section of the electromagnetic stirrer coil 2 is made 300 mm or less because interference between the flow discharged from the nozzle and the stirred flow can be avoided and a swirl can be stably formed near the melt surface. It is preferable to make the yoke width B smaller than the immersion depth L shown in FIG. 2. In general, the immersion depth L is 300 mm or so, therefore the upper limit was made 300 mm. Further, preferably, if the yoke width B is 250 mm or less, it is possible to reliably avoid interference between the flow discharged from the nozzle and the stirred flow.

Next, the reason for making the space factor (–) of the yoke 0.5 or more will be explained.

The inside area in the vertical cross-section of the electromagnetic stirrer coil 2, more specifically the inside area surrounded by the outside shape 7 of the coil window of FIG. 3, shows the size of the electromagnetic stirrer coil 2. The smaller this inside area, the more compact the electromagnetic stirrer coil becomes.

The magnitude of the magnetic force able to be formed by supplying current to the electromagnetic stirrer coil 2 is defined by the magnetomotive force. A high efficiency is realized if able to form the magnetic field able to be produced by that magnetomotive force inside the yoke 6 without magnetic saturation. Once magnetically saturated, even if increasing the magnetomotive force of the electromagnetic stirrer coil 2 over this, it is not possible to form a magnetic field commensurate with the increase in the magnetomotive force.

On the other hand, the maximum value of the magnetomotive force is 200 kAT or so. If over this, the problem of local heat buildup of the yoke 6 arises and steps such as making the yoke 6 an internally water cooled structure become necessary.

The inventors investigated the relationship between the space factor (–) of the sectional area (B×D) of the yoke 6 with respect to the inside area in the vertical cross-section of the electromagnetic stirrer coil 2 and the obtained thrust under the condition of a yoke width of 100 to 300 mm whereupon they learned that by making the space factor (–) 0.5 or more, substantially the desired thrust is obtained.

Therefore, in the present invention, the space factor (–) of the sectional area (B×D) of the yoke 6 with respect to the inside area in the vertical cross-section of the electromagnetic stirrer coil 2 (specifically, the inside area surrounded by the outer shape 7 of the coil window of FIG. 3) was made 0.5 or more. (See FIG. 5.)

In the present invention, the upper limit of the space factor is not defined, but from the viewpoint of the ease of production, 0.9 or less is a preferable range.

Further, according to the present invention, if there is leeway in the power capacity or if there is leeway in the flux density in the yoke to enable the magnetomotive force for obtaining the prescribed thrust to be obtained, it is also possible to increase the thrust in accordance with need.

Note that in the present invention, the method of increasing the space factor is not critical, but it is preferable to reduce the outside shape of the water cooled copper pipe forming the coil to for example 4.0 mm or less to reduce the bending radius of the copper pipe and thereby bring the inside shape of the coil close to the sectional shape of the yoke.

Further, the magnetomotive force F of the electromagnetic stirrer coil divided by the yoke width B, that is, the value of F/B, is preferably 800 kAT/m or more. This is because making the magnetomotive force F/yoke width B 800 kAT/m or more avoids interference between the flow discharged from the immersion nozzle and the stirred flow and enables a stirring speed required for prevent inclusions from being trapped in the solidified shell to be obtained.

Embodiment

Figure 4:
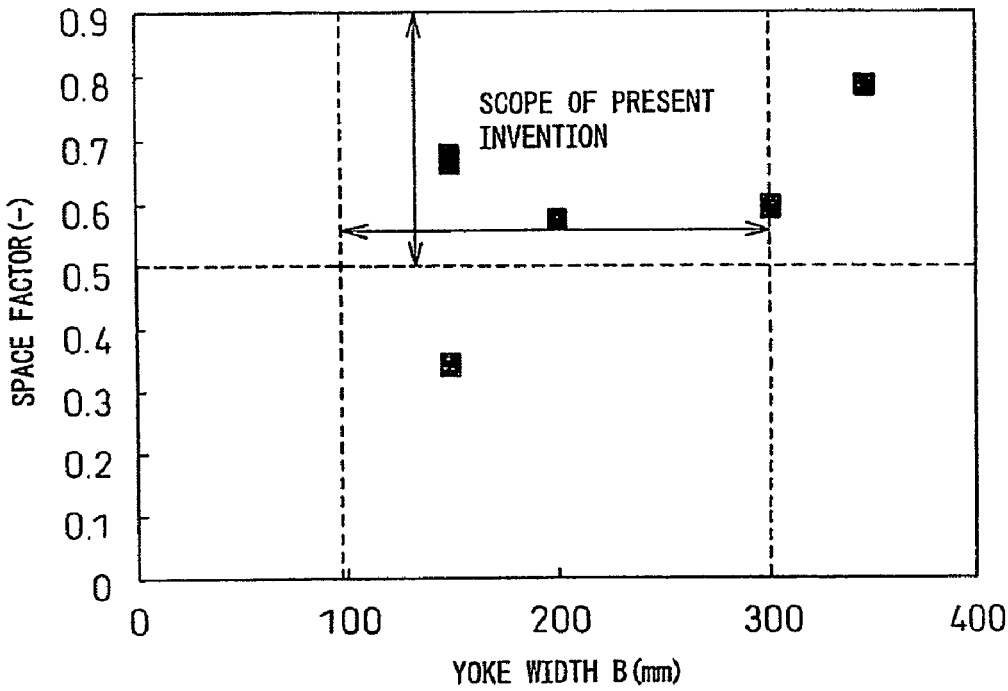
FIG. 4 is a view showing the relationship between the yoke width B and the above-mentioned space factor.
Figure 5:
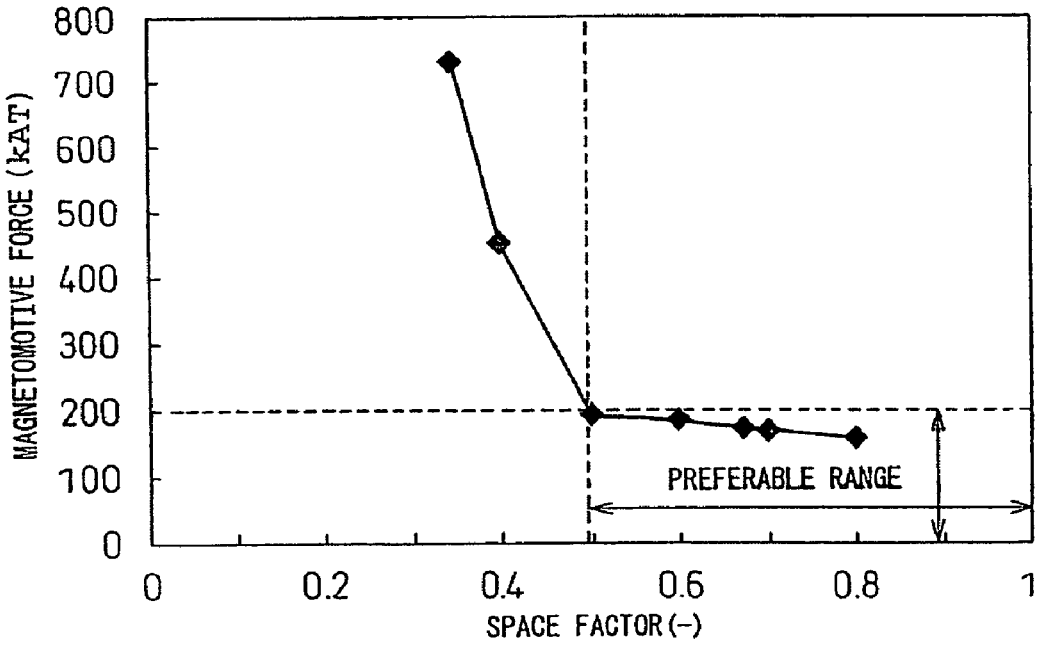
FIG. 5 is a view showing the relationship between the space factor (–) and the magnetomotive force for obtaining the necessary thrust.
Figure 6:
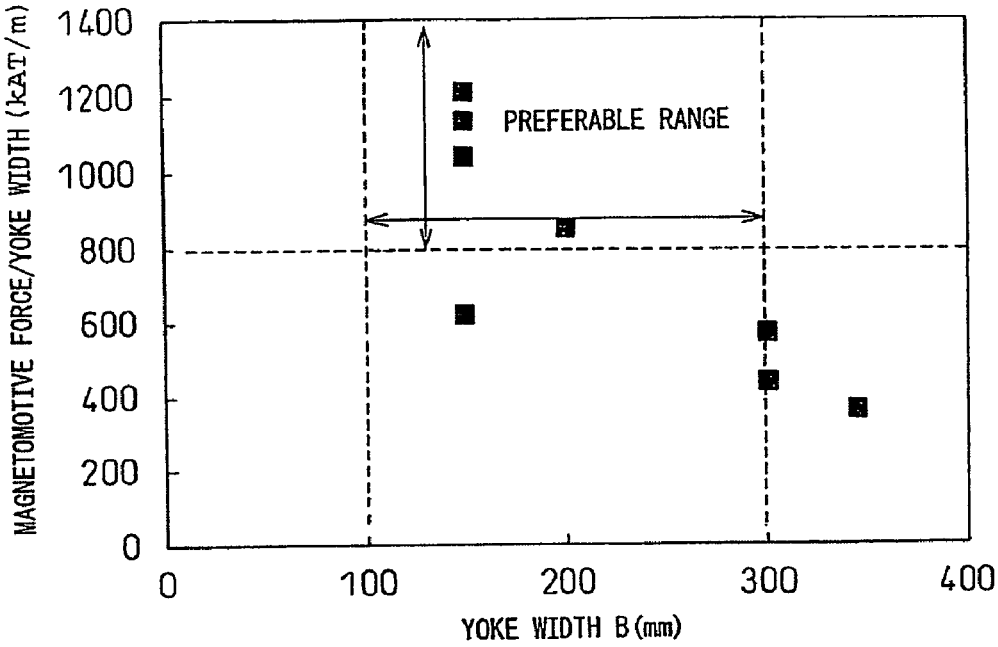
FIG. 6 is a view showing the relationship between the yoke width B and the magnetomotive force F/yoke width B.

An embodiment of the electromagnetic stirrer coil of the present invention will be shown in FIG. 4 to FIG. 6.

The inventors prepared several coils differing in yoke width and space factor and investigated whether the prescribed thrust of 10,000 Pa/m could be obtained. Here, the "thrust" means the value of the force acting on a brass plate measured using a strain gauge etc. in the state placing the brass plate at a position 15 mm from the inside wall of the mold and running current through the electromagnetic stirrer coil and is shown in units of Pa/m.

Further, the inventors used the electromagnetic stirrer coils for actual casting. The type of the steel was low carbon Al killed steel. This molten steel was cast into a slab of a thickness of 250 mm and a width of 1800 mm. The casting speed was 1 m/min. The nozzle was run through with Ar gas at a rate of 3 Nl/min. The immersion depth L was made 300 mm. Regarding the number of bubbles and inclusions at the surface part of the slab, the inventors cut out samples of the total width×casting direction length 200 mm from the top surface and bottom surface of the slab, ground away the bubbles and inclusions in a surface of the total width×length 200 mm at every other 1 mm from the surface, and investigated the sum of the numbers of bubbles and inclusions of 100 microns or more size down to 10 mm from the surface.

In addition, to clarify whether or not the stirred flow by the electromagnetic stirrer coil and the flow discharged from the immersion nozzle will interfere with the flow rising along the short sides to near the melt surface inside the mold, the inventors investigated the solidified structure in the horizontal cross-section of the slab.

FIG. 4 is a view showing the relationship between the yoke width B and the above-mentioned space factor. In FIG. 4, the scope of the present invention is shown by the arrows. That is, when the prepared electromagnetic stirrer coils had a space factor of 0.5 or more and a core thickness of 100 mm to 300 mm, the prescribed thrust stirring could be imparted. Further, under those conditions, even if investigating the solidified structure of the slab, it was confirmed that the dendrites growing from the slab surface toward the inside grew with a uniform angle in the upwind direction of the flow across the slab total width.

FIG. 5 is a view of the relationship between the space factor (–) and the magnetomotive force for obtaining a prescribed thrust. Note that FIG. 5 includes several plots. These show the results of preparation of several electromagnetic stirrer coils with different space factors and study of the conditions for giving the target thrust of 10,000 Pa/m under the respective conditions. From FIG. 5, by making the space factor (–) 0.5 or more, the required thrust can be applied without magnetic saturation. Here, the rapid increase in the magnetomotive force with a space factor (–) of less than 0.5 shows that magnetic saturation has occurred.

Figure 7:
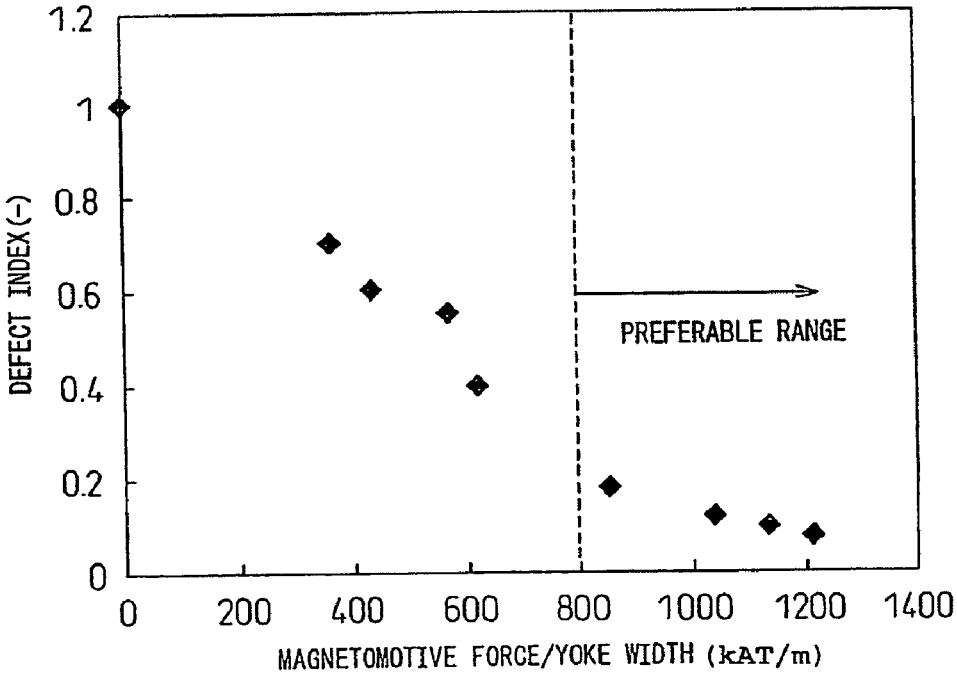
FIG. 7 is a view showing the results of the present invention.

The relationship between the magnetomotive force F/yoke width B and the defects occurring in a slab when using the several electromagnetic stirrer coils differing in yoke width B and magnetomotive force F/yoke width shown in FIG. 6 is shown in FIG. 7. The "defect index" shown at the ordinate of FIG. 7 shows the sum of the number of bubbles and inclusions down to 10 mm from the slab surface found under several conditions and indexed to the number when not applying electromagnetic stirring as "1". In FIG. 7, it was confirmed that increasing the magnetomotive force/yoke width reduces the defect index, but in particular making it 800 kAT/m or more enables remarkable reduction. Based on the results of FIG. 7, FIG. 6 shows the preferable range of the present invention by arrows.

INDUSTRIAL APPLICABILITY

According to the present invention, it is possible to provide a compact and high thrust electromagnetic stirrer coil by specifying preferable ranges of numerical values for the space factor of the yoke sectional area (–) with respect to an inside area in a vertical cross-section of the electromagnetic stirrer coil corresponding to the effective area of the core (yoke) and for the yoke width B, interference between the stirred flow and the flow discharged from the immersion nozzle can be avoided and a swirl can be stably formed near the melt surface, and other useful remarkable effects in industry are exhibited.

The invention claimed is:

1. A method for stirring molten steel, comprising (i) providing an apparatus containing molten steel, said apparatus comprising a mold and an electromagnetic stirrer coil comprising a coil formed by a water cooled copper pipe having an outer diameter of 4 mm or less wound around a yoke for stirring molten steel in said mold by electromagnetic force, wherein said electromagnetic stirrer coil is arranged along a length direction of a side of said mold and is parallel to said length direction of said side of said mold and is characterized in that a space factor of a yoke sectional area located within an inside area of a vertical cross-section of said coil formed by the copper pipe with respect to said inside area is in the range of 0.5 to 0.9 and a yoke width B is 100 mm to 300 mm; and (ii) stirring molten steel in said mold by supplying a current through said electromagnetic stirrer coil wherein said electromagnetic stirrer coil generates a magnetomotive force F wherein F/B is in the range from 800 kAT/m to 1400 kAT/m.

2. A method for molding a steel slab by a casting process, characterized by (i) providing an apparatus for stirring molten steel, said apparatus comprising:

a mold having a rectangular horizontal cross-section formed by a first and a second long side and a first and a second short side, wherein said mold comprises a nozzle at the center of the mold, said nozzle having an immersion depth L from the top of said mold, a first electromagnetic stirrer coil arranged along a length direction outside said first long side within a depth L from the top of said mold and parallel to said length direction of said first long side, and a second electromagnetic stirrer coil arranged along a length direction outside said second long side within a depth L from the top of said mold and parallel to said length direction of said second long side, wherein each said electromagnetic stirrer coil comprises a coil formed by a water cooled copper pipe having an outer diameter of 4 mm or less wound around a yoke for stirring molten steel in said mold by electromagnetic force and is characterized in that a space factor of a yoke sectional area located within an inside area of a vertical cross-section of said coil formed by the copper pipe with respect to said inside area is in the range of 0.5 to 0.9 and a yoke width B is less than L and in the range of 100 mm to 300 mm, and wherein the first and second electromagnetic stirrer coils are arranged in a manner such that a thrust generated by the first electromagnetic stirrer coil is in an opposite direction to a thrust generated by the second electromagnetic stirrer coil in said mold;

(ii) injecting molten steel into said mold through said nozzle; and (iii) stirring molten steel in said mold by a swirl produced by the thrusts from the first and second electromagnetic stirrer coils, wherein each said electromagnetic stirrer coil generates a magnetomotive force F wherein F/B is in the range from 800 kAT/m to 1400 kAT/m.

3. The method for molding a steel slab of claim 1, wherein said thrusts from the first and the second electromagnetic stirrer coils produce a stable swirl near a surface of the molten steel without causing an interference between a flow discharged from the nozzle and a stirred flow.

* * * * *